US005682649A

United States Patent [19]

Lo

[11] Patent Number: 5,682,649

[45] Date of Patent: Nov. 4, 1997

[54] SEALING CLIP STRIP STRUCTURE

[76] Inventor: Luke Lo, No.9, Lane 34 Chin Men St., Taipei, Taiwan

[21] Appl. No.: 691,709

[22] Filed: Aug. 2, 1996

[51] Int. Cl.[6] ..... B65D 77/00

[52] U.S. Cl. ..... 24/30.5 R; 24/543

[58] Field of Search ..... 24/30.5 R, 30.5 P, 24/551, 552, 543, 545, 555

[56] References Cited

U.S. PATENT DOCUMENTS

| | | | |
|---|---|---|---|
| 3,621,539 | 11/1971 | Ayers | 24/30.5 R |
| 3,713,622 | 1/1973 | Dinger | 24/543 |
| 3,824,654 | 7/1974 | Takabayashi | 24/543 |
| 4,742,601 | 5/1988 | Furutsu | 24/30.5 R |
| 4,926,526 | 5/1990 | Brown et al. | 24/30.5 R |
| 5,008,980 | 4/1991 | Zimmermann | 24/30.5 R |
| 5,109,576 | 5/1992 | Teekell et al. | 24/30.5 R |
| 5,123,146 | 6/1992 | Olson | 24/30.5 R |
| 5,152,034 | 10/1992 | Konings et al. | 24/30.5 R |

*Primary Examiner*—Victor N. Sakran

*Attorney, Agent, or Firm*—Bacon & Thomas

[57] ABSTRACT

A sealing clip strip structure which is an integrated strip plate with a predetermined length. The sealing clip strip is formed with a lengthwise folding groove along a central line of the sealing clip strip, which divides the sealing clip strip into an upper and a lower clip plates. On the edges of the upper and lower clip plates are respectively formed corresponding latch section and hook section, whereby the upper and lower clip plates are folded toward each other about the folding groove to make the latch section latched by the hook section so as to clip and seal an opening of a bag body. At least one end section of the sealing clip strip is obliquely cut into a slope end, whereby after the upper and lower clip plates are folded to clip the opening of the bag body, the end section becomes a disaligned extension section in order to facilitate the opening operation of the sealing clip strip.

3 Claims, 10 Drawing Sheets

SEALING CLIP STRIP STRUCTURE

BACKGROUND OF THE INVENTION

The present invention relates to a sealing clip strip structure which is an integrated strip plate with a predetermined length. The sealing clip strip is formed with a lengthwise folding groove along a central line of the sealing clip strip, which divides the sealing clip strip into an upper and a lower clip plates. The upper and lower clip plates are foldable toward each other about the folding groove to clip and seal an opening of a bag body. At least one end section of the sealing clip strip is obliquely cut into a slope end, whereby after the upper and lower clip plates are folded to clip the opening of the bag body, the end section forms a disaligned extension section in order to facilitate the opening operation of the sealing clip strip.

A conventional sealing clip is V-shaped, consisting of an upper and a lower clip plates which are ready to be folded toward each other to clip and seal an opening of a bag body. Several shortcomings exist in such conventional sealing clip as follows:

1. The upper and lower clip plates are assembled into an open state ready for clipping the opening of the bag body. When a plurality of such sealing clips are stacked together, a great room is occupied so that it is inconvenient and expensive to transfer and store the sealing clips.

2. After folded, the upper and lower clip plates are flushly engaged with each other and thus it is difficult to re-open the sealing clip.

3. The upper and lower clip plates cannot be tightly engaged with each other so that the opening of the bag body cannot be reliably sealed.

4. The upper and lower clip plates are adjoined at transverse ends. When suffering an external force, the free ends of the upper and lower clip plates are apt to automatically stretch open.

SUMMARY OF THE INVENTION

It is therefore a primary object of the present invention to provide an improved sealing clip strip structure which is an integrated strip plate with a predetermined length. The sealing clip strip is formed with a lengthwise folding groove along a central line of the sealing clip strip, which divides the sealing clip strip into an upper and a lower clip plates. The upper and lower clip plates are foldable toward each other about the folding groove to reliably clip and seal an opening of a bag body. At least one end section of the sealing clip strip is obliquely cut into a slope end, permitting the sealing clip strip to be easily stretched open.

The present invention can be best understood through the following description and accompanying drawings, wherein:

DETAILED DESCRIPTION OF THE PREFERRED EMBODIMENTS

Figure 1:
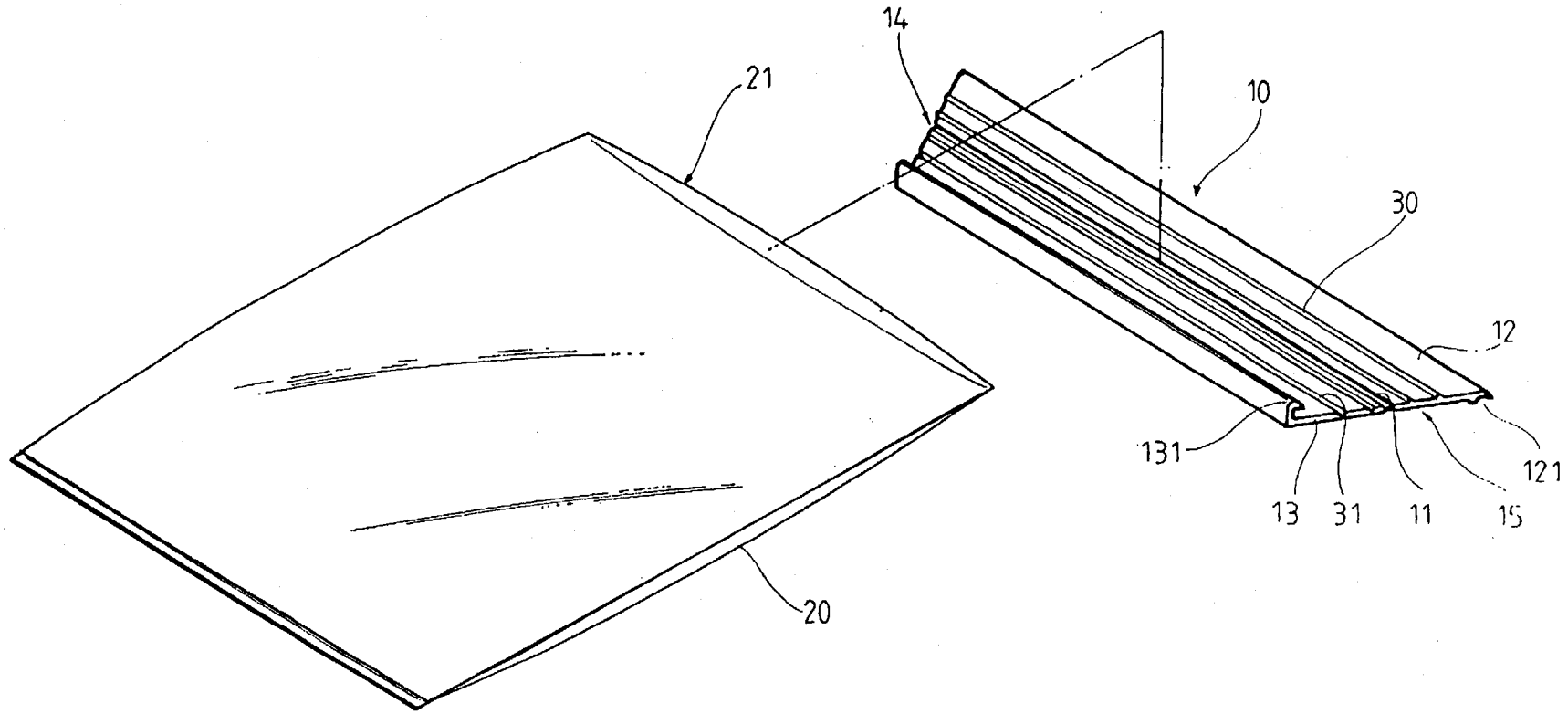
FIG. 1 is a perspective view of a first embodiment of the present invention in a state prior to application.
Figure 2:
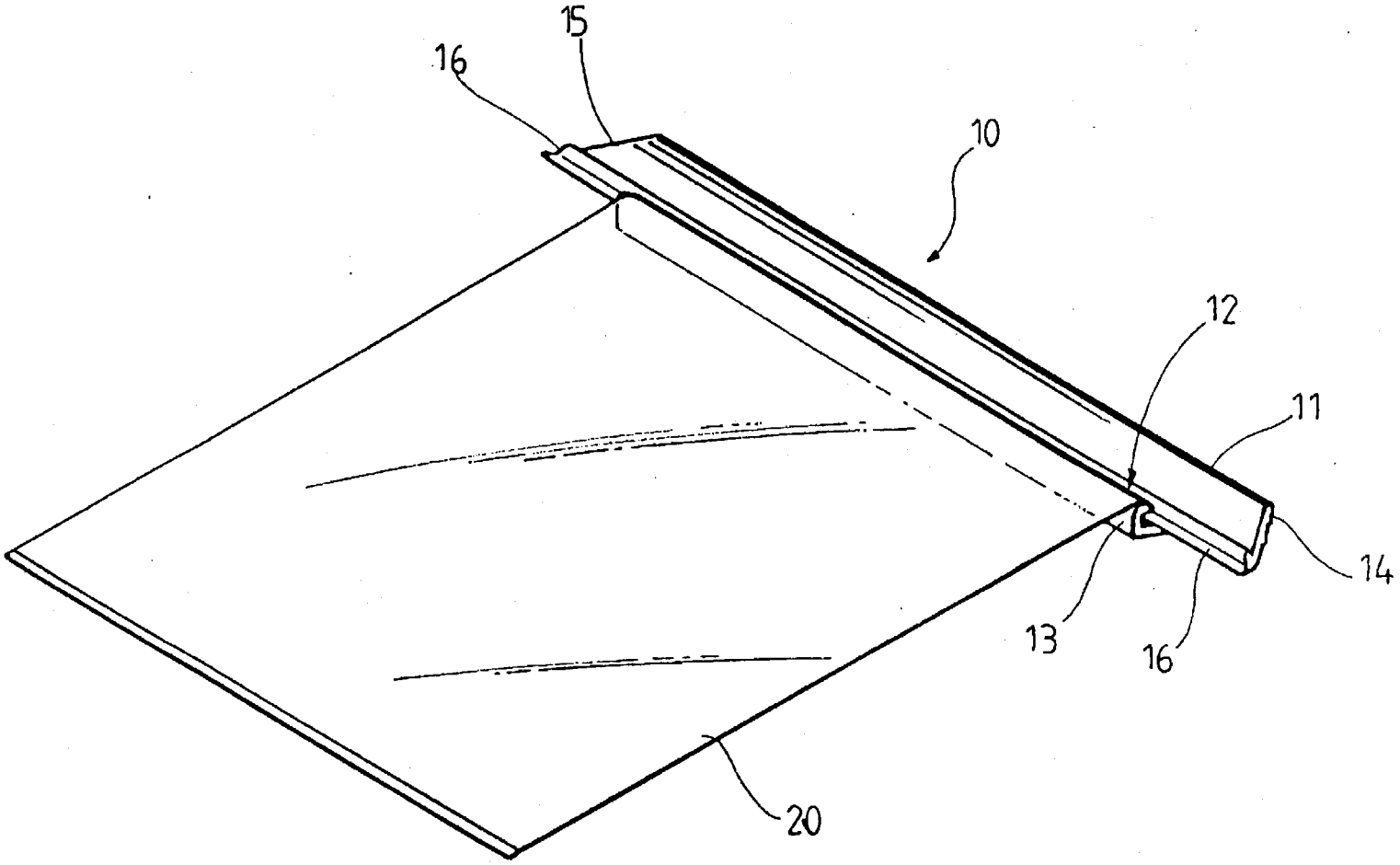
FIG. 2 is a perspective view of the first embodiment of the present invention in a state of application.
Figure 3:
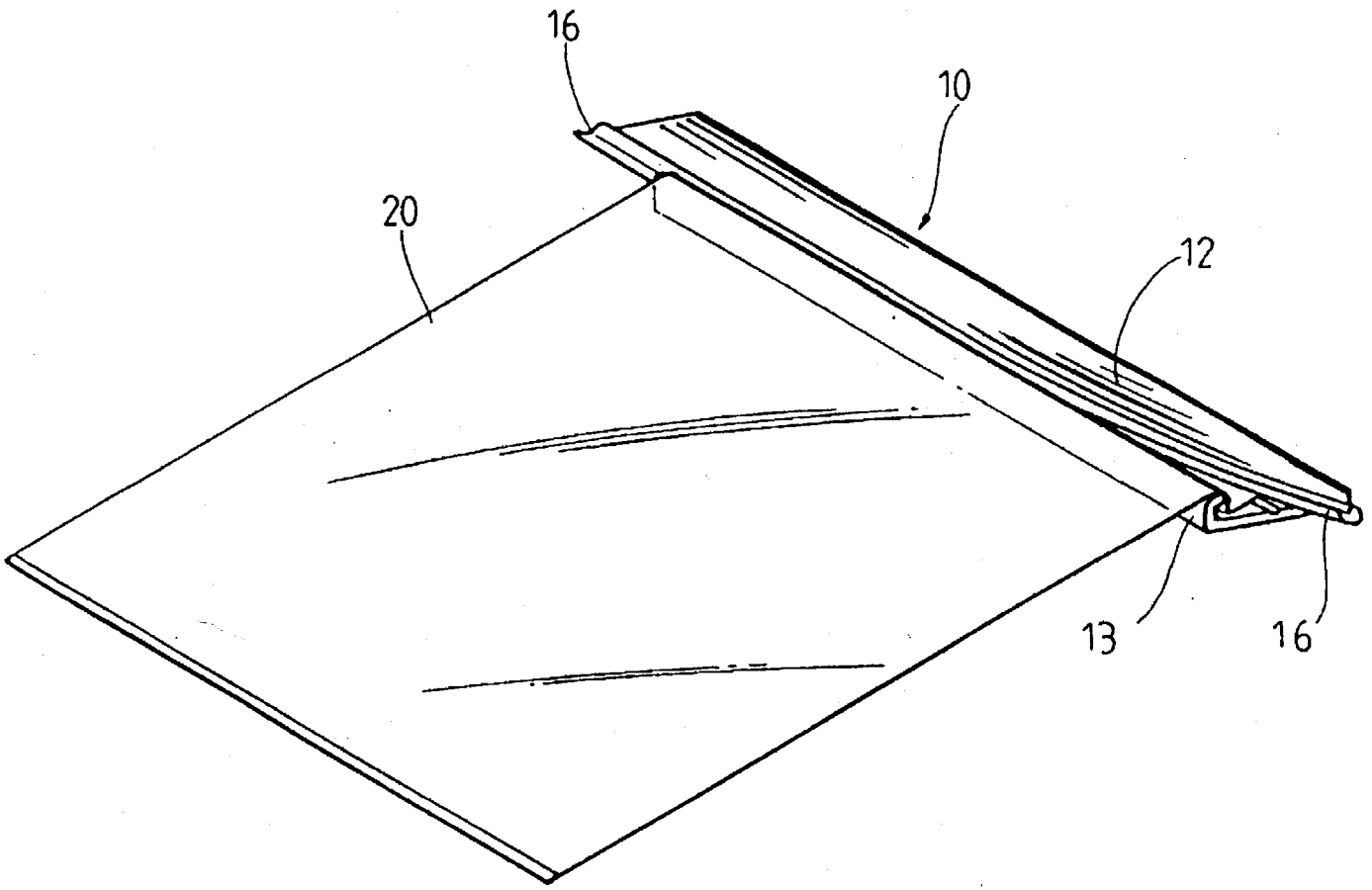
FIG. 3 is a perspective view of the first embodiment of the present invention in a state of opening.
Figure 4:
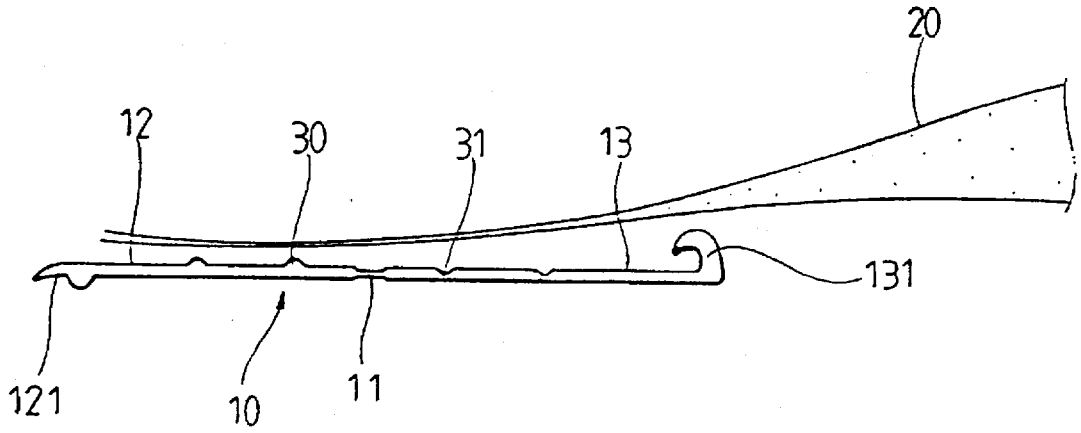
FIG. 4 is a sectional view of the first embodiment of the present invention in a state prior to clipping operation.
Figure 5:
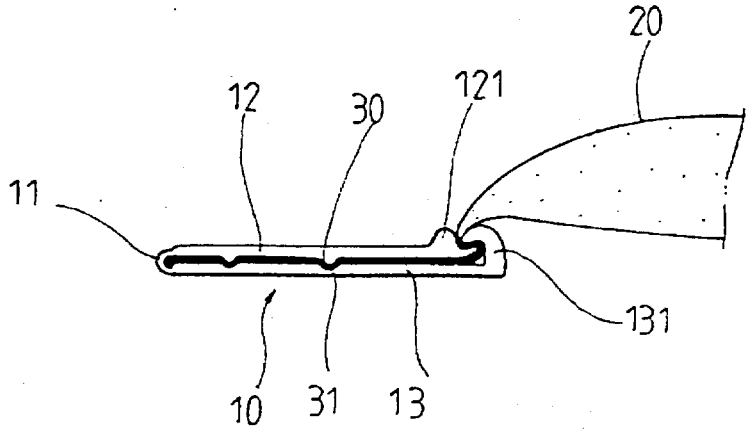
FIG. 5 is a sectional view of the first embodiment of the present invention in a state during clipping operation.
Figure 7:
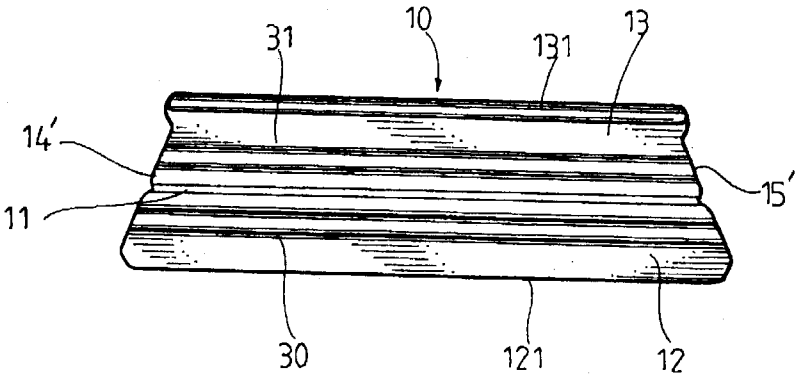
FIG. 7 is a front view of a second embodiment of the present invention.
Figure 6:
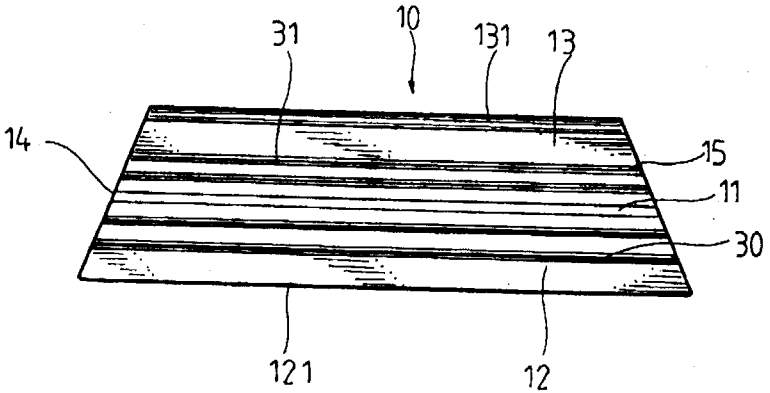
FIG. 6 is a front view of the first embodiment of the present invention.

Please refer to FIGS. 1 to 6 which show a first embodiment of the present invention, wherein the sealing clip strip 10 is an integrated strip plate with a predetermined length. The sealing clip strip 10 is formed with a lengthwise folding groove 11 along a central line of the sealing clip strip 10, which divides the sealing clip strip 10 into an upper and a lower clip plates 12, 13. On the edges of the upper and lower clip plates 12, 13 are respectively formed corresponding latch section 121 and hook section 131, whereby the upper and lower clip plates 12, 13 can be folded toward each other about the folding groove 11 to make the latch section 121 latched by the hook section 131 so as to clip and seal an opening of a bag body 20. In addition, several corresponding pressing ribs 30 and receiving channels 31 are respectively formed on the opposite faces of the upper and lower clip plates 12, 13 for increasing the clipping effect. In order to facilitate the opening operation of the sealing clip strip 10, at least one end section 14, 15 of the sealing clip strip 10 is obliquely cut into a slope end, whereby after the upper and lower clip plates 12, 13 are folded to clip the opening of the bag body 20, the end section 14, 15 becomes a disaligned extension section 16 as shown in FIG. 2. Therefore, when it is desired to unlatch and open the upper and lower clip plates 12, 13, the end portions 14, 15 of the upper and lower clip plate 12, 13 can be easily held and forced apart by a user's fingers as shown in FIG. 3. As shown in FIG. 7, the edge of the slope end 14, 15 can be alternatively formed with multiple curved sides 14', 15' or other tapered sides instead of straight sides.

Figure 8:
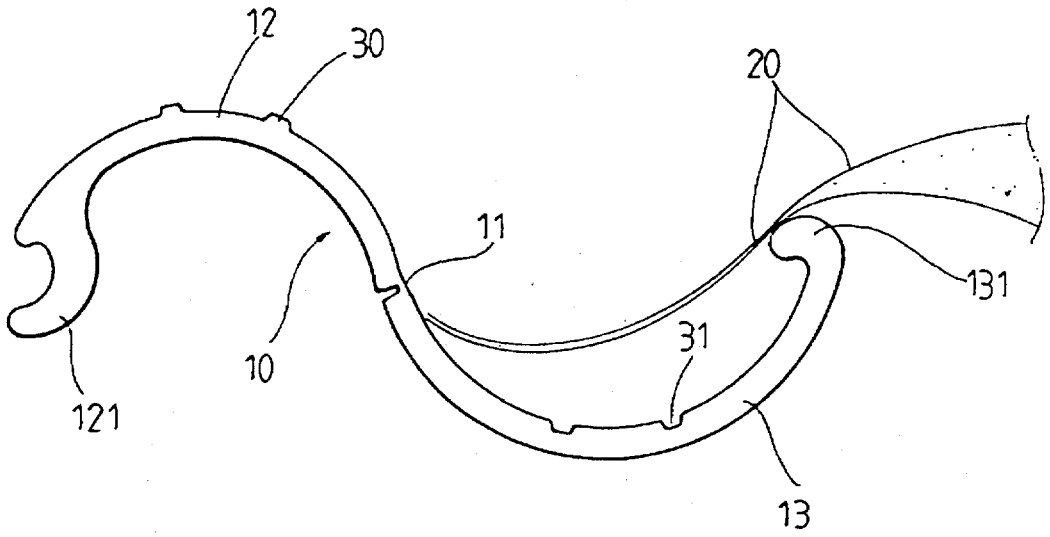
FIG. 8 is a sectional view of a third embodiment of the present invention in a state prior to clipping operation.
Figure 9:
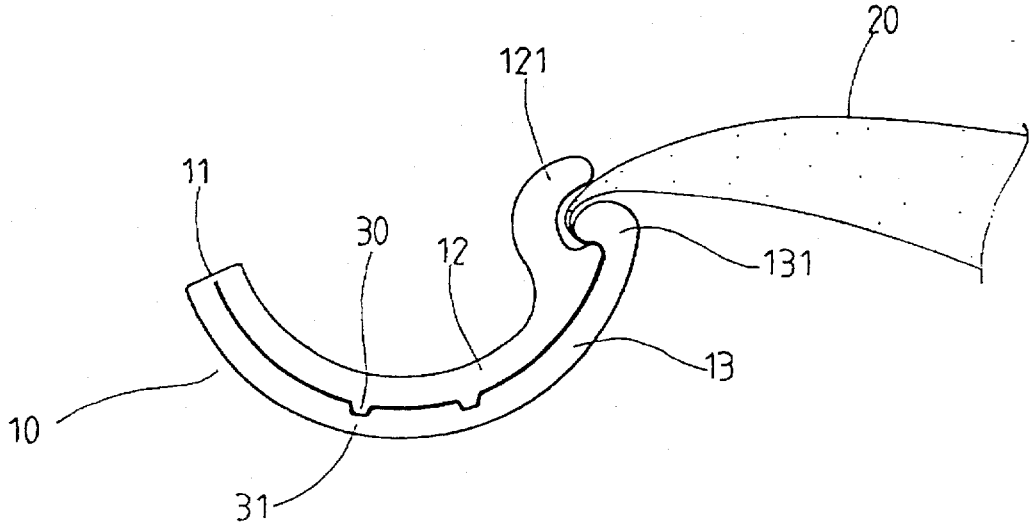
FIG. 9 is a sectional view of the third embodiment of the present invention in a state during clipping operation.
Figure 10:
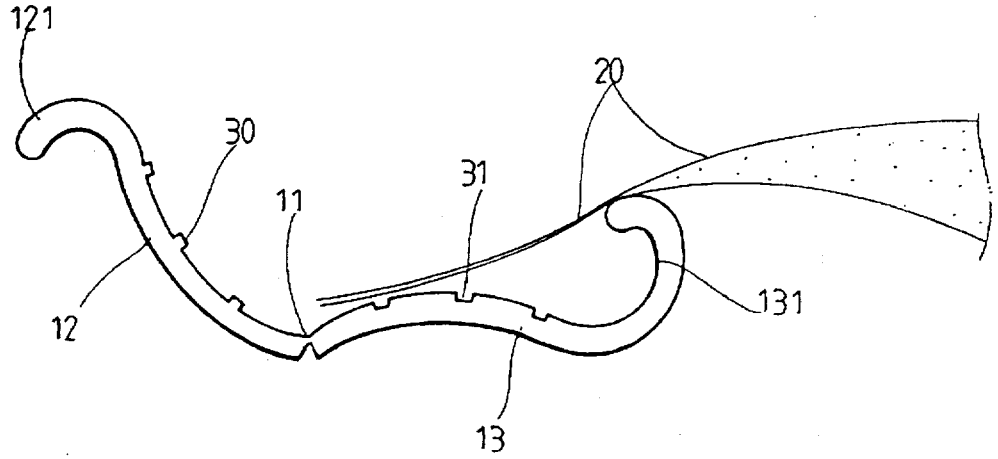
FIG. 10 is a sectional view of a fourth embodiment of the present invention in a state prior to clipping operation.
Figure 11:
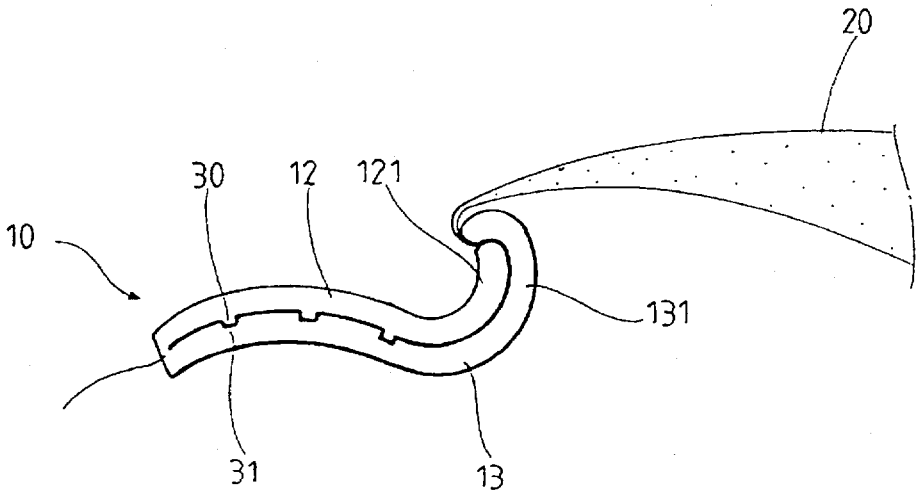
FIG. 11 is a sectional view of the fourth embodiment of the present invention in a state during clipping operation.
Figure 12:
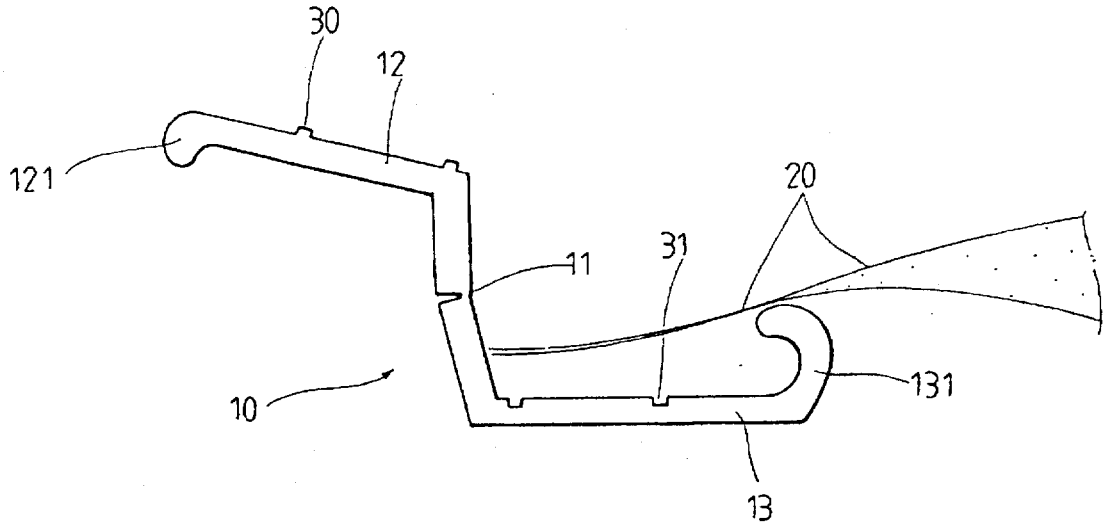
FIG. 12 is a sectional view of a fifth embodiment of the present invention in a state prior to clipping operation.
Figure 13:
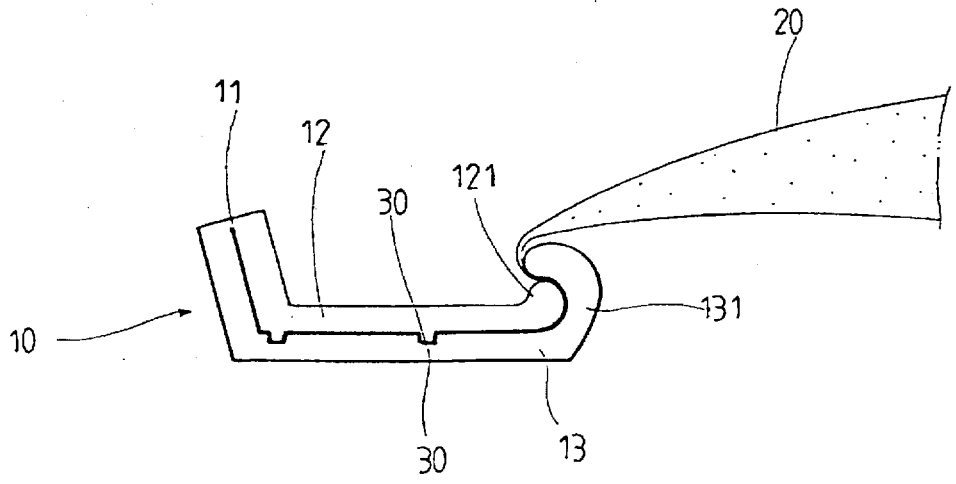
FIG. 13 is a sectional view of the fifth embodiment of the present invention in a state during clipping operation.
Figure 14:
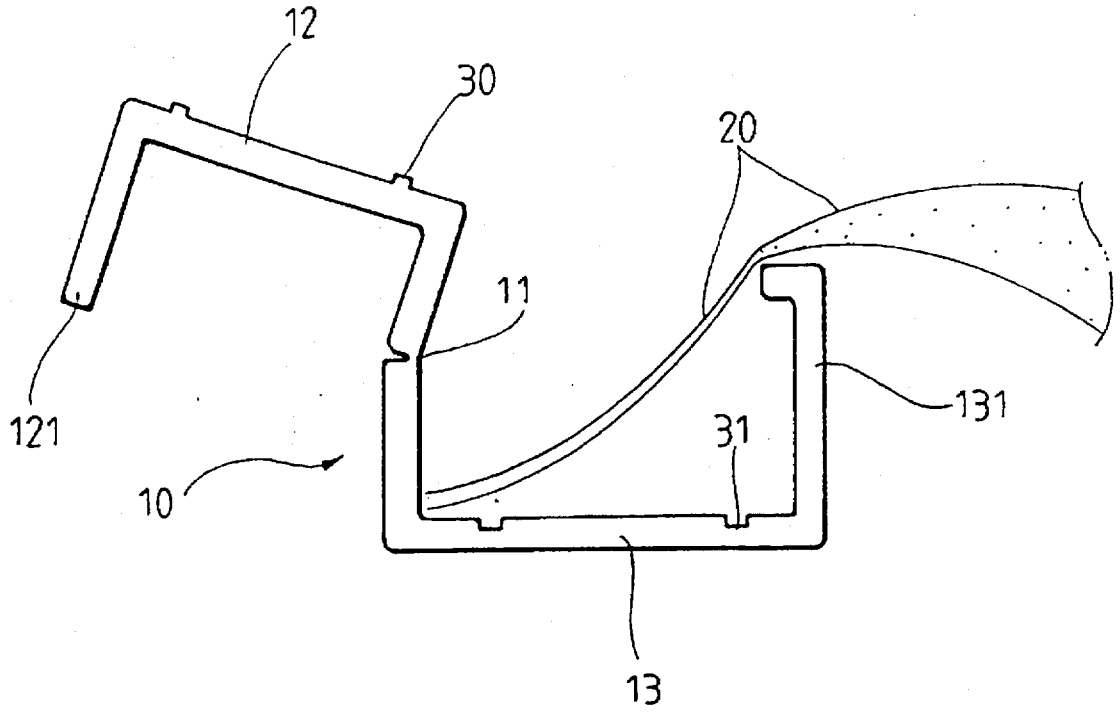
FIG. 14 is a sectional view of a sixth embodiment of the present invention in a state prior to clipping operation.
Figure 15:
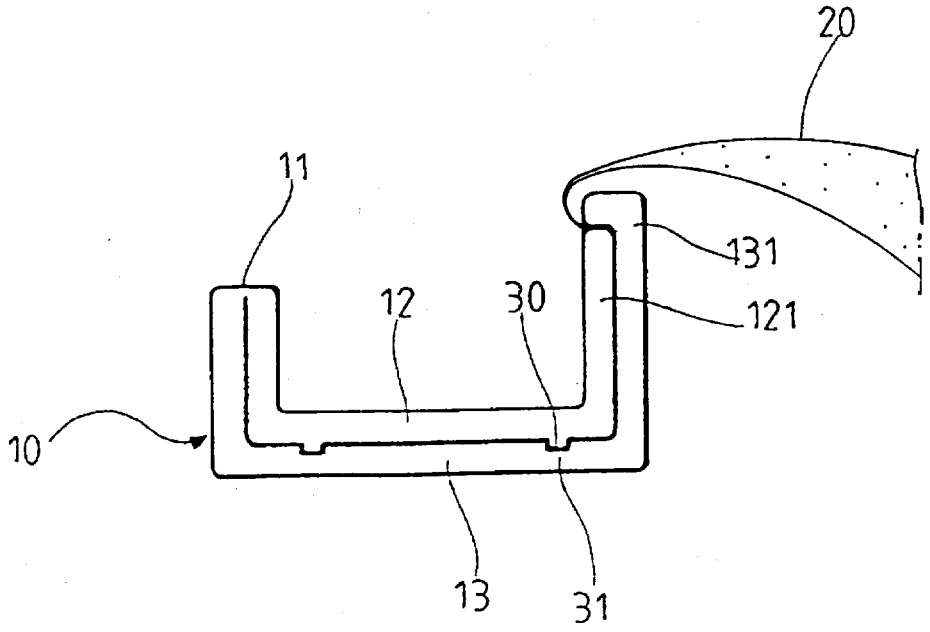
FIG. 15 is a sectional view of the sixth embodiment of the present invention in a state during clipping operation.

Alternatively, the upper and lower clip plates 12, 13 can be formed with various kinds of curved or bent shapes as necessary. FIGS. 8 and 9 show that the upper and lower clip plates 12, 13 are formed with arch cross-section. FIGS. 10 and 11 show that the upper and lower clip plates 12, 13 are formed with a cross-section having multiple arch segments. FIGS. 12, 13 show that the upper and lower clip plates 12, 13 are formed with a cross-section having combined arch and bent segments. FIGS. 14, 15 show that the upper and lower clip plates 12, 13 are formed with a cross-section having multiple bent segments.

Figure 16:
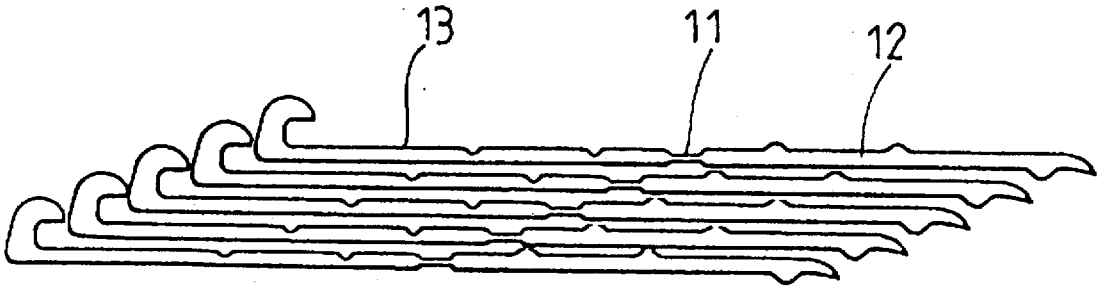
FIG. 16 shows that a plurality of the sealing clip strips are stacked together.

According to the above arrangements, in use, the upper and lower clip plates 12, 13 of the sealing clip strip 10 are first positioned at the opening 21 of the bag body 20. Then the upper and lower clip plates 12, 13 are folded toward each other to clip and seal the opening 21 between the opposite faces of the upper and lower clip plates 12, 13 as shown in FIGS. 2, 5, 9, 11, 13 and 15. By means of the cooperative pressing ribs 30 and the receiving channels 31, the opening 21 is pressed and clipped between the opposite faces of the upper and lower clip plates 12, 13 with a better sealing effect. Moreover, the upper and lower clip plates 12, 13 can be folded about the folding groove 11 into a plane state, whereby a plurality of sealing clip strips can be stacked without occupying much room so as to facilitate the transferring and storage of the sealing clip strips as shown in FIG. 16.

It should be noted that the above description and accompanying drawings are only used to illustrate some embodiments of the present invention, not intended to limit the scope thereof. Any modification of the embodiments should fall within the scope of the present invention.

What is claimed is:

1. A sealing clip strip which is an integrated strip plate with a predetermined length, the sealing clip strip being formed with a lengthwise folding groove along a central line of the sealing clip strip extending between opposite lateral end sections, the folding groove dividing the sealing clip strip into upper and lower clip plates having longitudinal edges forming engaging latch and hook sections, wherein at least one of the opposite lateral end sections extends obliquely to the folding groove, such that, when the upper and lower clip plates are folded toward each other to engage the latch and hook sections, the oblique end section of one of the upper and lower clip plates extends laterally outwardly beyond the oblique end section of the other of the upper and lower clip plate.

2. The sealing clip strip as claimed in claim 1, further comprising a plurality of corresponding pressing ribs and receiving channels respectively formed on opposite faces of the upper and lower clip plates.

3. The sealing clip as claimed in claim 1 wherein the at least one oblique end section is formed with curved and tapered portions.

* * * * *